US006632073B2

(12) United States Patent
Newcomer

(10) Patent No.: US 6,632,073 B2
(45) Date of Patent: Oct. 14, 2003

(54) AIR-OPERATED PUMP WITH BLADDER-CONTROLLED INLET STRUCTURE USEFUL IN FLOATING-LAYER SEPARATION APPLICATIONS

(76) Inventor: Kevin L. Newcomer, 13734 Shady La., Monroe, MI (US) 48161

( * ) Notice: Subject to any disclaimer, the term of this patent is extended or adjusted under 35 U.S.C. 154(b) by 28 days.

(21) Appl. No.: 10/001,608

(22) Filed: Oct. 23, 2001

(65) Prior Publication Data

US 2003/0077180 A1 Apr. 24, 2003

(51) Int. Cl.[7] ..... F04F 1/06

(52) U.S. Cl. ..... 417/118; 417/137; 137/173; 166/68; 210/170

(58) Field of Search ..... 417/46, 118, 137, 417/138; 137/173, 206, 209; 166/68, 267, 313, 370, 372; 210/170

(56) References Cited

U.S. PATENT DOCUMENTS

| | | | | | |
|---|---|---|---|---|---|
| 3,669,275 | A | | 6/1972 | Downs | 210/242 |
| 4,243,529 | A | | 1/1981 | Strauss | 210/109 |
| 4,273,650 | A | | 6/1981 | Solomon | 210/104 |
| 4,580,952 | A | * | 4/1986 | Eberle | 417/383 |
| 4,663,037 | A | | 5/1987 | Breslin | 210/170 |
| 4,872,994 | A | | 10/1989 | Jakob | 210/691 |
| 4,886,432 | A | * | 12/1989 | Kimberlin | 417/478 |
| 4,936,383 | A | * | 6/1990 | Towner et al. | 166/68 |
| 4,998,585 | A | | 3/1991 | Newcomer et al. | 166/105 |
| 5,058,669 | A | * | 10/1991 | Wells | 166/107 |
| 5,147,184 | A | | 9/1992 | Newcomer et al. | 417/394 |
| 6,220,823 | B1 | | 4/2001 | Newcomer | 417/118 |
| 6,224,343 | B1 | * | 5/2001 | Newcomer | 417/118 |

* cited by examiner

*Primary Examiner*—Charles G. Freay
*Assistant Examiner*—John F Belena
(74) *Attorney, Agent, or Firm*—Gifford, Krass, Groh, Sprinkle, Anderson & Citkowski, PC

(57) ABSTRACT

An air-operated, submersible pump features a bladder-controlled inlet applicable to water pumping or fluid separation, including the recovery of viscous hydrocarbon products. The inlet area fluidly penetrates through a portion of the wall of the pump, and the bladder, disposed within the pump body, is supported in overlying registration therewith. A pressure-operated valve in fluid communication with the discharge port facilitates a refill mode of operation, wherein fluid surrounding the pump flows into the pump body through the inlet area, and a discharge mode of operation wherein the air inlet is pressurized, causing the bladder to inflate and seat against and seal off the inlet area, and fluid which flowed into the pump body to be discharged through the discharge port. In the preferred embodiment, the inlet area comprises a plurality of apertures formed through the wall of the pump body arranged as one or more linear arrays lengthwise along the pump. When deployed to separate and recover a layer of fluid floating on water, a pump according to the invention pump further includes a water outlet and a water-outlet seal. During the refill mode of operation, water including the floating layer of fluid flows into the pump body through the inlet area, and in the discharge mode of operation, the pressurization further causes water which flowed into the pump body to be discharged through the water outlet until the outlet is sealed, after which the fluid which flowed into the pump body is discharged through the discharge port.

17 Claims, 5 Drawing Sheets

A-A

REFILL

DISCHARGE

REFILL

DISCHARGE

DISCHARGE

REFILL

AIR-OPERATED PUMP WITH BLADDER-CONTROLLED INLET STRUCTURE USEFUL IN FLOATING-LAYER SEPARATION APPLICATIONS

FIELD OF THE INVENTION

This invention relates to fluid pumping apparatus and, more particularly, to a submersible pump that may be used to separate and recover an underground layer of floating fluid, including hydrocarbons.

BACKGROUND OF THE INVENTION

It is often desirable, and sometimes required, to decontaminate groundwater by pumping contaminants from a well. This is possible if the contaminant is a separate or floating layer on or within the groundwater. If the contaminant is a hydrocarbon, an added benefit is that the fluid may be recycled for reuse. Pumps used to remove a floating liquid layer to an elevated location are disclosed in U.S. Pat. Nos. 6,220,823; 5,147,184; 3,669,275; 4,243,529; 4,273,650; 4,663,037; 4,872,994; and 4,998,585.

A problem with existing designs is that they often require numerous component parts, including moving parts, and therefore tend to be complex. Such products often use stationary inlets in conjunction with hydrophobic screens, floating inlets attached to coils, or more complex inlet structures used in conjunction with sensors and pneumatic cylinders. Stationary inlets may be mispositioned out of the product when the water level drops, or they can be completely submerged under the water if the level raises to an unacceptably high degree Hydrophobic screens can be easily fouled and plugged, and floating inlets can hang up for various reasons. Coils may also be plugged by discharged hydrocarbons, such as spent motor oil and other thicker fluids.

In my U.S. Pat. No. 6,220,823, I describe an air-operated, submersible pump having a simplified inlet design, resulting in an economical and reliable apparatus that many be used for water pumping of fluid separation, including the recovery of viscous hydrocarbon products. The pump includes a pump body having a length, a wall, an air inlet, and a discharge port. The inlet area fluidly penetrates through a portion of the wall, and a flexible seal, disposed within the pump body, is supported in overlying registration with the fluid inlet. A pressure-operated valve in fluid communication with the discharge port facilitates a refill mode of operation, wherein fluid surrounding the pump flows into the pump body through the inlet area; and a discharge mode of operation wherein the air inlet is pressurized, causing the seal to seat against and seal off the inlet area, and fluid which flowed into the pump body to be discharged through the discharge port. The inlet area preferably comprises a plurality of apertures formed through the wall of the pump body arranged as one or more linear arrays lengthwise along the pump. The apertures may include a raised rim where they protrude into the pump body thereby helping the seal to seat thereagainst. Alternatively, the inlet area may incorporate slots, a mesh or screen panel, or a porous member, including a hydrophobic screen.

When deployed to separate and recover a layer of fluid floating on water, a pump according to the invention pump further includes a water outlet and a water-outlet seal. During the refill mode of operation, water including the floating layer of fluid flows into the pump body through the inlet area, and in the discharge mode of operation, the pressurization further causes water which flowed into the pump body to be discharged through the water outlet until the outlet is sealed, after which the fluid which flowed into the pump body is discharged through the discharge port. In implementing this design, I have found that relatively high pressure, on the order of 40 p.s.i., is required to satisfactorily seal the flap to the inlet region. At lower pressures, of 30 p.s.i. and less, for example, the integrity of the seal could be compromised, causing back flow and potential turbulence, potentially upsetting the product/water interface.

SUMMARY OF THE INVENTION

This invention resides in an improved, air-operated, submersible pump having a bladder-controlled inlet design resulting in an economical and reliable apparatus that may be used for water pumping of fluid separation, including the recovery of viscous hydrocarbon products.

The pump includes a pump body having a length, a wall with a fluid inlet area, exhaust line, an air inlet, discharge port and a bladder air-supply line. The inlet area fluidly penetrates through a portion of the wall, and an air-operated bladder, disposed within the pump body, is supported in overlying registration with the fluid inlet. A set of pressure-operated valves facilitate a refill mode of operation, wherein fluid surrounding the pump flows into the pump body through the inlet area, and a discharge mode of operation wherein the bladder is pressurized to seat against and seal off the bladder inlet area, following fluid which flowed into the pump body to be discharged through the discharge port.

In the preferred embodiment, the inlet area comprises a plurality of apertures formed through the wall of the pump body arranged as one or more linear arrays lengthwise along the pump. The apertures may include a raised rim where they protrude into the pump body thereby helping the bladder to seat thereagainst. Alternatively, the inlet area may incorporate slots, a mesh or screen panel, or a porous member, including a hydrophobic screen.

When deployed to separate and recover a layer of fluid floating on water, a pump according to the invention pump further includes a water outlet and a water-outlet seal. The water-outlet seal preferably comprises a check ball seat, and a density-less-than-water check ball which engages with the seat in the presence of fluid from the floating layer.

The separate bladder air-supply line and air-supply/exhaust lines include pressure-operated valves that sequence in alternating fashion as the pump cycles between refill and discharge states. During refill, a low flow is permitted out of the bladder air-supply line, so that the bladder can move away from the fluid inlet area. An exhaust valve in the air-supply/exhaust line allows the volume of the pump body to be discharged rapidly, enabling a quick refill of fluid into the pump body. To discharge, a high flow into the bladder air-supply line inflates the bladder, causing it to seal off the fluid inlet area, while a relatively low flow enters into the air-supply/exhaust line, to push the water out the water-outlet until it seals off, after which time the fluid of interest is pumped out the discharge line, and the cycle repeats.

The valve configuration, which may be located above-ground or on the pump body, permits a conventional above-ground controller to be used to operate the pump. During the refill mode of operation, water including the floating layer of fluid flows into the pump body through the inlet area, and in the discharge mode of operation, the pressurization further causes water which flowed into the pump body to be discharged through the water outlet until the outlet is sealed, after which the fluid which flowed into the pump body is discharged through the discharge port.

DETAILED DESCRIPTION OF THE INVENTION

Figure 1A:
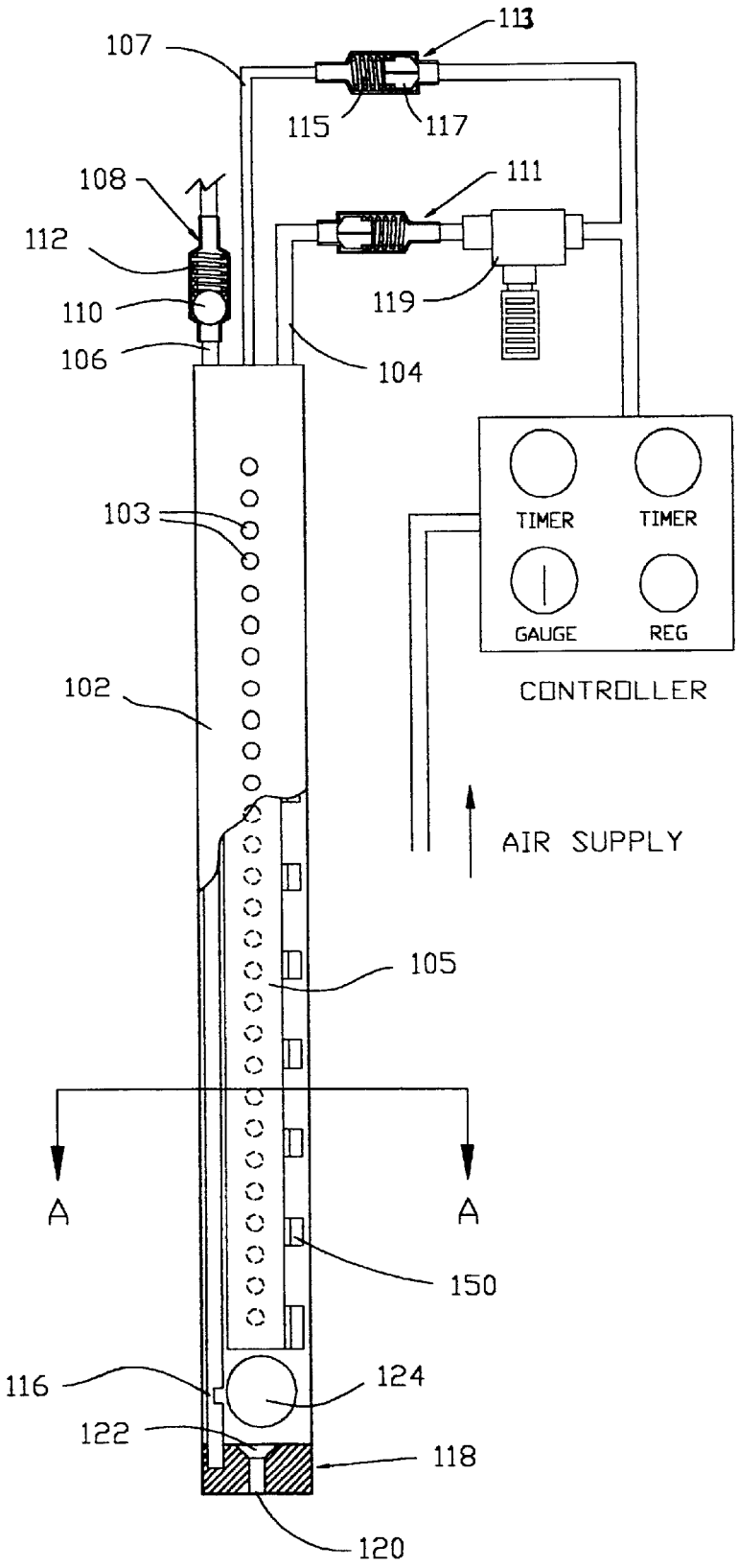
FIG. 1A is a drawing, in partial cross-section, of a submersible pump according to the invention utilizing an inflatable/deflatable bladder disposed within the body of the pump.

Reference will now be made to the drawings, which will help to understand the refill and discharge modes of operation. In addition, the following numerical references will be used throughout:

102 Body
103 Perforations
104 Air supply and exhaust line
105 Bladder
106 Discharge line
107 Bladder air supply line
108 Discharge check valve
110 Check ball
111 Air supply check valve with orifice
112 Discharge check spring
113 Bladder air supply check valve with orifice
115 Air check spring
116 Discharge inlet point
117 Poppet with orifice
119 Quick exhaust valve
120 Water outlet passage
122 Valve seat
124 Floating ball
130 Lighter than product/water fluid
132 Aquifer water
140 Small volume of water
142 Product/water interface
150 Bladder support channel
151 O-ring
152 Bladder stem
160 Adjustable discharge tube
161 O-ring
162 Floating back flow checkball
163 Cage
164 Slot for adjustment
165 Back flow notch FIG. 1A is a drawing which illustrates a preferred pump configuration according to the invention. The body 102 is preferably an elongated cylinder constructed of a corrosion-resistant material such as stainless steel. Other materials and geometries may be used, however, with the length of the body being adjustable from a few inches to several feet, depending upon the application. To address a wide range of needs, a preferred design is configured to fit within a two-inch diameter well or larger.

The air supply and exhaust line 104 is interconnected to an above-ground pneumatic controller, which may be a commercially available unit or one of the types described in U.S. Pat. Nos. 6,206,657 and 6,224,343, the contents of both of which are incorporated herein by reference. The discharge line 106 interconnects directly to a discharge check assembly 108 having a spring 112 operative to urge a check ball 110 against a lower seat until a predetermined pressure within line 106 is reached.

Along the body 102 of the pump, there is disposed a series of apertures or perforations 103, which penetrate through the way of a body 102 and into the interior of the pump. In the preferred embodiment, at least one row of such apertures are disposed longitudinally along the body of the pump, though, additional rows having a varying spacing may alternatively be used. In addition, and in all configurations of the invention, as opposed to a plurality of apertures, the inlet area may be made with slots, mesh, screen, a porous member and/or a hydrophobic screen.

Figure 1B:
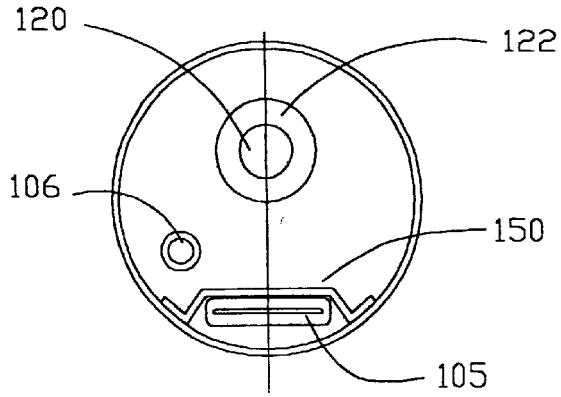
FIG. 1B is a section of the pump of FIG. 1A taken along line A—A.
Figure 1C:
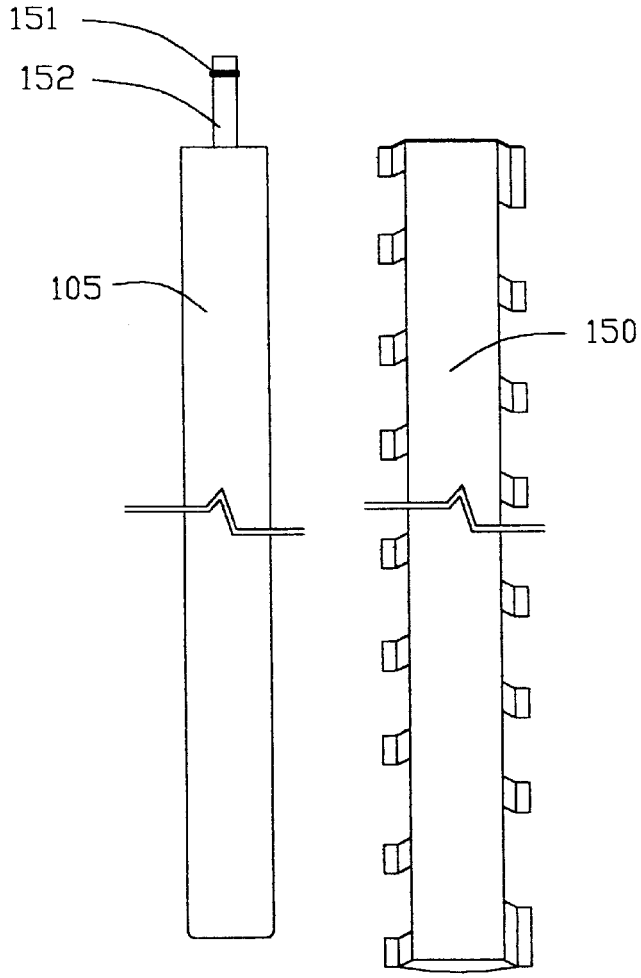
FIG. 1C is a side-view drawing of a support channel used to hold the bladder in place relative to the fluid inlet area.

According to the invention, immediately behind the apertures 103 there is disposed an inflatable bladder 105, which presses against the perforations from the inside to seal them off during the discharge mode of operation described with reference to FIGS. 1E and 1G. Materials such as neoprene, synthetic rubber, Teflon and other materials may be used to construct the bladder 105. As shown in the cross-section A—A of FIG. 1B and FIG. 1C, a bladder support panel 150 constructed of stainless steel or other non-corrosive material is used to contain the bladder 105 so that it will not be dislocated as pressure is exerted against the perforations forming the fluid inlet. The support panel 150 is preferably tack-welded to the inner wall of the pump body 102.

The bladder 105 preferably includes a stem 152 and O-ring 151, facilitating maintenance for replacement. The bladder 105 is inflated and deflated through a separate bladder air-supply line 107, which includes a separate check valve 113 including a poppet with orifice 117 urged against a seat using an air-check spring 115.

Figure 1D:
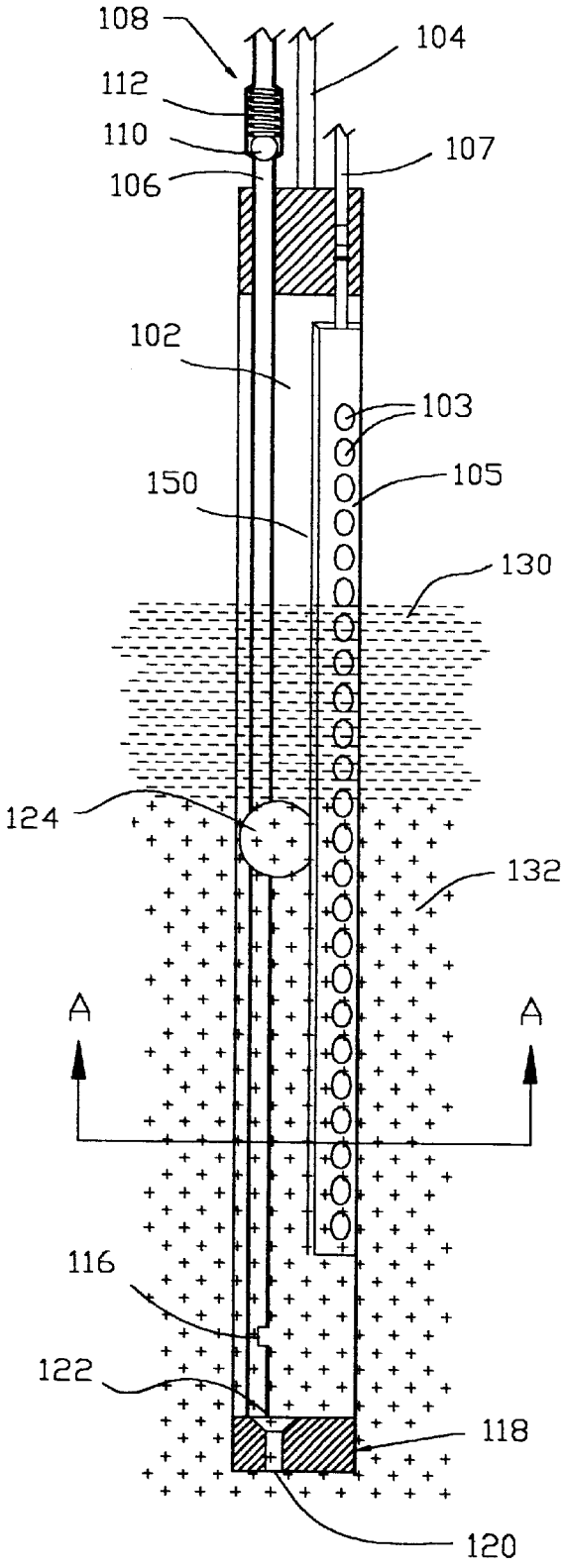
FIG. 1D is a drawing of the pump of FIG. 1A, having completed a refill cycle.
Figure 1E:
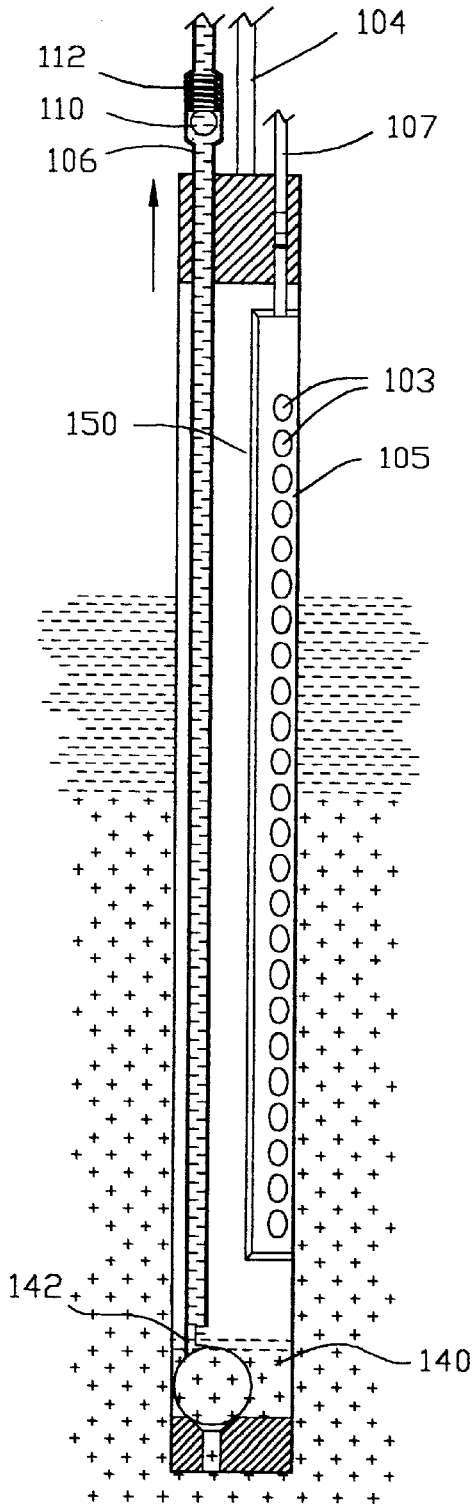
FIG. 1E is a drawing of the pump of FIG. 1A, having completed a discharge cycle.
Figure 1F:
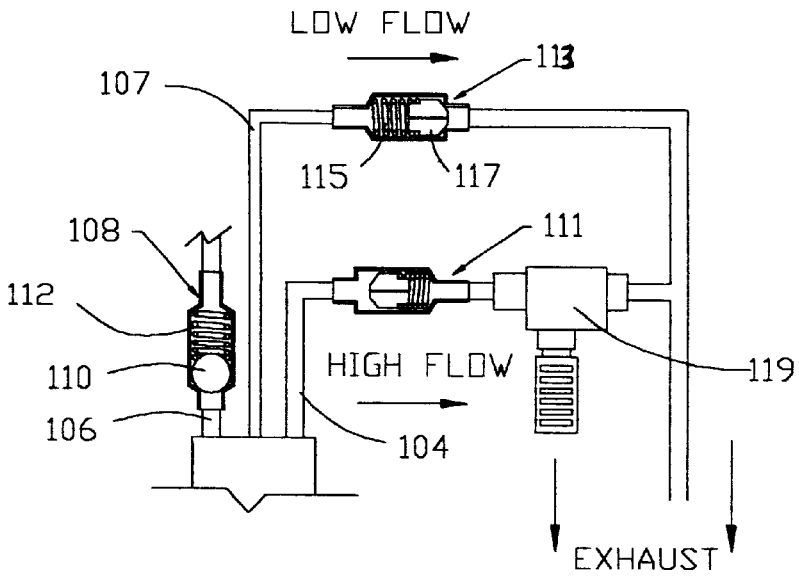
FIG. 1F is a detailed drawing of the valves used in conjunction with the refill mode of operation.

FIGS. 1D and 1F show the pump in a refill mode, wherein fluid is entering the perforations 103 and into the pump body, with the bladder 105 deflating away from the apertures 103 to permit fluid to flow to enter into the pump body. Although the perforations 103 may be made through the wall of the pump body without any raised areas, in the preferred embodiment, the perforations 103 include dimples facing inwardly of the body, such that when the bladder inflates thereagainst, a tighter seal is realized.

As best seen in FIG. 1F, during the refill mode, a high flow of trapped air is exhausted through the opening of air supply check valve with orifice 111 and through quick exhaust valve 119. The device 119 permits a flow of air through the valve from the air supply during the discharge mode of operation, while, with the air supply turned off, allowing a rapid exhaust through the side port. In concert with the high flow of trapped air through valves 111 and 119, although valve 113 is closed, the orifice through the poppet 117 permits a low flow of air therethrough, which enables the bladder to sufficiently deflate and move away from the fluid inlet.

At the lower end 118 of the pump, there is disposed a water outlet passage 120 featuring a valve seat 122. The floating ball 124 is shown floating on top of a water layer 132. The bottom extent of the discharge line is shown at point 116. Pumps according to the invention may be used for different purposes, including the pumping of a singular fluid, such as water. Alternatively, the pumps of this invention may be used for fluid separation purposes, for example, to recover hydrocarbons found floating on a layer 130 above an aquifer 132. In such a case, the float 124 is composed of a material which will float on water, but which will sink in the layer of hydrocarbon 130, which may be gasoline, or other types of petroleum distillates and fuels.

Figure 1G:
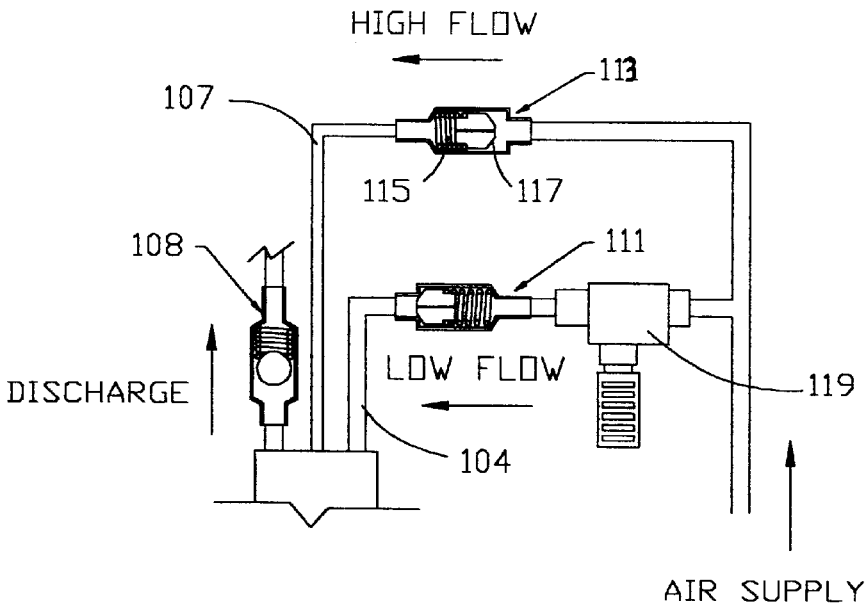
FIG. 1G depicts the valves of FIG. 1F during a discharge mode of operation.

FIGS. 1E and 1G show the pump during a discharge cycle, wherein the fluid layer 130 is forced out of the pump body. To begin this process, the surface controller supplies a surge of compressed air to valves 111 and 113 along line 104. The spring 112 has sufficient strength to hold the check ball 110 against the seat and discharge line 106, at least until pressure within the body of the pump proceeds to a predetermined level. As such, valve 113 opens, allowing a high flow of air into the pump body through line 107. This inflates the bladder 105 against the openings 103, sealing them off. At the same time, although valve 111 is closed, the orifice through the poppet member allows a relatively low flow therepast, through valve 119 and into the pump body through line 104. The increasing pressurization causes the floating ball 124 to move downwardly toward the distal end of the pump, forcing the water back out through the water outlet 120. This continues until the floating ball 124, as shown in FIG. 1E. A small volume of water 140 remains in the pump, but the body of the pump is now otherwise sealed from discharges other than discharge line 106.

Pressure continues to build within the body of the pump to a level beyond that just required to push the check ball 110 away from the seat. This causes the lighter-than-water fluid 130 to be forced up through the discharge line, past the check ball for above-ground recovery. The bladder 105 remains urged against the openings 103 until the pressurization delivered through line 104 ceases. At this point, line 104 returns to atmosphere, and becomes an exhaust line, allowing the bladder 105 to deflate and move away from the inlets, as described above, allowing a new charge to enter into the pump body, thus commencing the next full cycle.

Although valves 111 and 113 are depicted as independent items, they may, in fact, be integrated into a single block which may also include the valve 119. In addition, although it is assumed that valves 111, 113 and 119 are disposed above ground, they may be situated proximate to the pump body, allowing a single line from the controller to extend from the surface down to the submerged pump, thereby obviating the need for a lengthly air-supply line for the bladder.

It should further be noted that the timing of the cycles, as well as the pressures to which the valves are set, the size of the various tubes and orifices, may be adjusted in accordance with known engineering principles to achieve a desired level of operation in accordance with tradeoffs regarding throughput, pump depth, and other factors. For example, the pump may be pressurized to a level on the order of 50 psi to expel the fluid collected during the refill mode, but again, this value is variable in accordance with valve oepration, pump depth, and so forth.

Figure 2A:
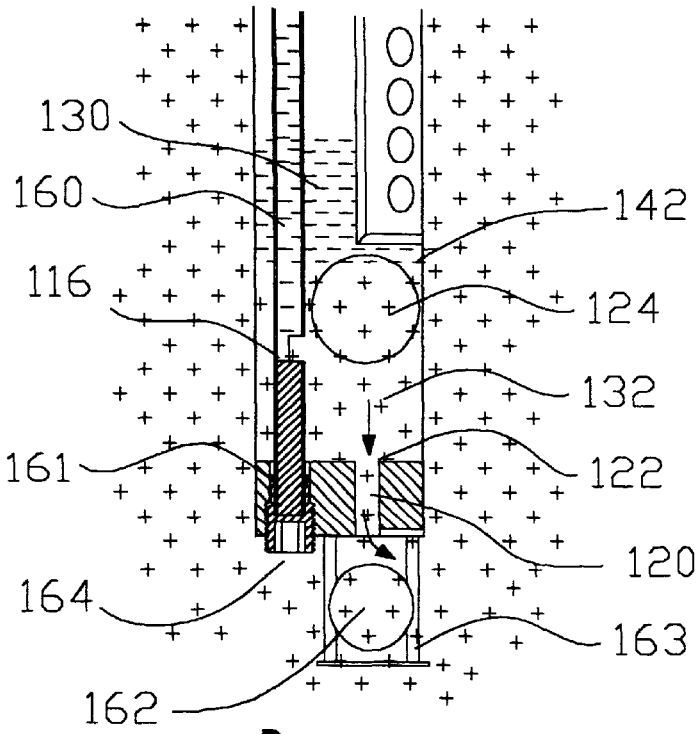
FIG. 2A shows an embodiment of the invention having an adjustable discharge tube which allows for fine adjusting of the discharge inlet.

FIG. 2A illustrates the addition of an adjustable discharge tube 160 which allows for fine adjusting of the discharge inlet 116. The lower end of the discharge tube is threaded and is sealed by O-ring 161. The differences between light and heavy weight floating product layers, in conjunction with differences between the aquifers salt/mineral contain, or temperature could affect the location of the interface 142, at the instant the floating ball 124 seals off the water outlet passage 120. If the floating ball 124 is floating too high at the interface 142, excess product 130 could be left after each cycle. If the floating ball 124 is floating too low, unwanted water 132 could be forced up the discharge tube. Even the specific gravity of the floats will vary from pump-to-pump, due to tolerances allowed in their manufacturing.

The provision of an adjustable discharge inlet allows for the ability to raise or lower the discharge inlet to the best location depending on the actual specific gravity of the aquifer and/or the product being pumped. This modification is particularly valuable during production testing to ensure the discharge inlet 116 is properly positioned to ensure minimal pumping of water 132. The discharge tube 160 could be adjusted by means of a wide variety of driver methods, such as internal hex 164, external hex, stnadard slot, Philips' slot, Torx slot, square head, finger tip adjustment (knurled knob), etc.

Figure 2B:
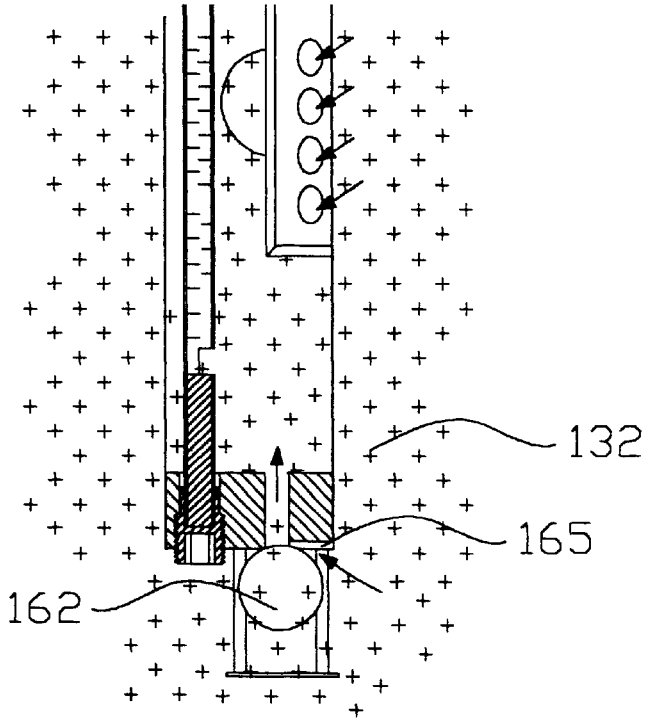
FIG. 2B illustrates the addition of an external lighter-than-water back flow check ball with a notch on the valve seat.

FIG. 2B illustrates the addition of an external lighter-than-water back flow check ball 162, with a notch 165 on the valve seat 122. This design allows a metered amount of water back into the pump, up through the water outlet passage 120.

It is desirable to reduce the flow of the water 132 back into the pump through the water outlet passage 120 to eliminate turbulence inside the pump chamber. Turbulence can cause emulsification of the floating product layer 130 and the water 132, which can result in water being pumped to the surface.

However, if a water back flow checkball 162 is added, and it has a near perfect seal, a lock between the floating ball 124 and its mating valve seat 122 can occur. This is more likely to occur when pumping extremely viscous or sticking products. The notch 165 allows hydraulic back pressure to build on the bottom side of the floating ball 124 force it off of its seat 122. The amount of back pressure available is dependent on the well's water level. The notch 165 will be sized to allow a free flow water into the pump while minimizing turbulence inside the pump. The back flow checkball 162 will be contained in a cage 163.

I claim:

1. An air-operated, submersible pump, comprising:

a pump body having a length, an outer wall, an air inlet, and a discharge port;

a fluid inlet area penetrating through at least a portion of the outer wall of the pump body;

an inflatable/deflatable bladder disposed within die pump body, the bladder being aligned in overlying registration with the fluid inlet area; and a pressure-operated valve in fluid communication with the discharge port, the plump having a refill mode of operation, wherein fluid surrounding the pump flows into the pump body through the inlet area and past the bladder, and a discharge mode of operation wherein the air inlet is pressurized, causing:

a) the bladder to inflate and seat against and seal off the fluid inlet area, and b) fluid which flowed into the pump body to be discharged through the discharge port.

2. The pump of claim 1, wherein the fluid inlet area comprises a plurality of apertures formed through the outer wall of the pump body.

3. The pump of claim 2, wherein the apertures are arranged as one or more linear arrays along the length of the pump body.

4. The pump of claim 2, wherein the apertures include a raised rim where they protrude into the pump body thereby helping the bladder to seat thereagainst.

5. The pump of claim 1, wherein the inlet area comprises one or more slots formed through the outer wall of the pump body.

6. The pump of claim 1, wherein the inlet area comprises a mesh, screen or porous member.

7. The pump of claim 6, wherein the inlet area comprises a hydrophobic screen.

8. The pump of claim 1, being adapted to separate and recover a layer of fluid floating on water, the pump further comprising:

a water outlet; and a water-outlet seal;

wherein, during the refill mode of operation, water including the floating layer of fluid flows into the pump body through the inlet area, and in the discharge mode of operation, the pressurization further causes water which flowed into the pump body to be discharged through the water outlet until the outlet is sealed, after which the fluid which flowed into the pump body is discharged through the discharge port.

9. The pump of claim 8, wherein the water-outlet seal further comprises:

a check ball seat; and a density-less-than-water check ball which engages with the seat in the presence of fluid from the floating layer.

10. The pump of claim 8, wherein the water-outlet seal further comprises:

a valve seat; and a water float having a valve stem which engages with the valve seat when the level of water within the pump body falls to a predetermined level.

11. An air-operated, submersible pump, comprising:

an elongated pump body having an inlet chamber with an outer wall, an air inlet, and a discharge port;

a plurality of apertures formed through the outer wall and into the inlet chamber, the apertures being spaced apart along the body of the pump;

an elongated bladder disposed within the inlet chamber in overlying registration with the apertures; and a pressure-operated valve in fluid communication with the discharge port, the pump having a refill mode of operation, wherein fluid surrounding the pump flows into the pump body through the apertures and past the bladder, and a discharge mode of operation wherein the air inlet is pressurized, causing:

a) the bladder to close off the apertures, and b) fluid which flowed into the pump body to be discharged through the discharge port.

12. The pump of claim 11, wherein the apertures are substantially round holes.

13. The pump of claim 11, wherein the apertures are elongated slots.

14. The pump of claim 11, wherein the apertures include a raised rim where they protrude into the pump body thereby helping the seal to seat thereagainst.

15. The pump of claim 11, being adapted to separate and recover a layer of fluid floating on water, the pump further comprising:

a water outlet; and a water-outlet seal;

wherein, during the refill mode of operation, water including the floating layer of fluid flows into the pump body through the apertures, and in the discharge mode of operation, the pressurization further causes water which flowed into the pump body to be discharged through the water outlet until the outlet is sealed, after which the fluid which flowed into the pump body is discharged through the discharge port.

16. The pump of claim 8, wherein the water-outlet seal further comprises:

a check ball seat; and a density-less-than-water check ball which engages with the seat in the presence of fluid from the floating layer.

17. The pump of claim 8, wherein the water-outlet seal further comprises:

a valve seat; and a water float having a valve stem which engages with the valve seat when the level of water within the pump body falls to a predetermined level.

* * * * *